United States Patent [19]

Focke et al.

[11] Patent Number: 4,723,394

[45] Date of Patent: Feb. 9, 1988

[54] APPARATUS FOR MAKING POUCH PACKS FOR TOBACCO

[75] Inventors: Heinz Focke; Oskar Balmer, both of Verden, Fed. Rep. of Germany

[73] Assignee: Focke & Co., Verden, Fed. Rep. of Germany

[21] Appl. No.: 803,442

[22] Filed: Dec. 2, 1985

Related U.S. Application Data

[60] Division of Ser. No. 714,049, Mar. 20, 1985, abandoned, which is a continuation-in-part of Ser. No. 647,492, Sep. 5, 1984, abandoned, which is a continuation of Ser. No. 421,614, Sep. 22, 1982, Pat. No. 4,505,385.

[30] Foreign Application Priority Data

Apr. 17, 1982 [DE] Fed. Rep. of Germany ..... 3214240

[51] Int. Cl.[4] ..... B65B 7/04

[52] U.S. Cl. ..... 53/562; 53/205; 53/371; 493/457

[58] Field of Search ..... 53/562, 378, 379, 371, 53/206, 205; 206/260, 245; 493/245, 260, 262, 457, 449, 453, 451

[56] References Cited

U.S. PATENT DOCUMENTS

| | | | |
|---|---|---|---|
| 1,172,209 | 2/1916 | Hill | 53/205 X |
| 2,189,729 | 2/1940 | Evans et al. | 53/562 X |
| 2,893,297 | 7/1959 | Soffa et al. | 493/457 X |
| 2,964,312 | 12/1960 | Schmidt | 493/457 X |
| 3,685,249 | 8/1972 | Jackson | 53/206 X |
| 4,402,403 | 9/1983 | Focke et al. | 206/260 X |

FOREIGN PATENT DOCUMENTS

| | | | |
|---|---|---|---|
| 2061713 | 5/1981 | United Kingdom | 206/260 |

*Primary Examiner*—James F. Coan

*Attorney, Agent, or Firm*—Sughrue, Mion, Zinn, Macpeak, and Seas

[57] ABSTRACT

In pouch packs for tobacco or the like of the "side-folding pouch" type, it is difficult to make a hermetic closure for the orifice of a pocket of the pouch pack, because accumulations of material impeding the provision of a closing seam or the like arise in the edge regions as a result of the construction of the pack. For this reason, the pouch pack is spread out to the full width of the blank in the region of the orifice for the provision of a closing seam, the closing seam is then made and the projecting lengths of material thus formed in the region of a covering tab are folded over inwards against the latter. This results in a pouch pack which is closed in an absolutely leak-proof manner and which has an essentially cuboid shape after completion.

5 Claims, 11 Drawing Figures

APPARATUS FOR MAKING POUCH PACKS FOR TOBACCO

Figure 1:
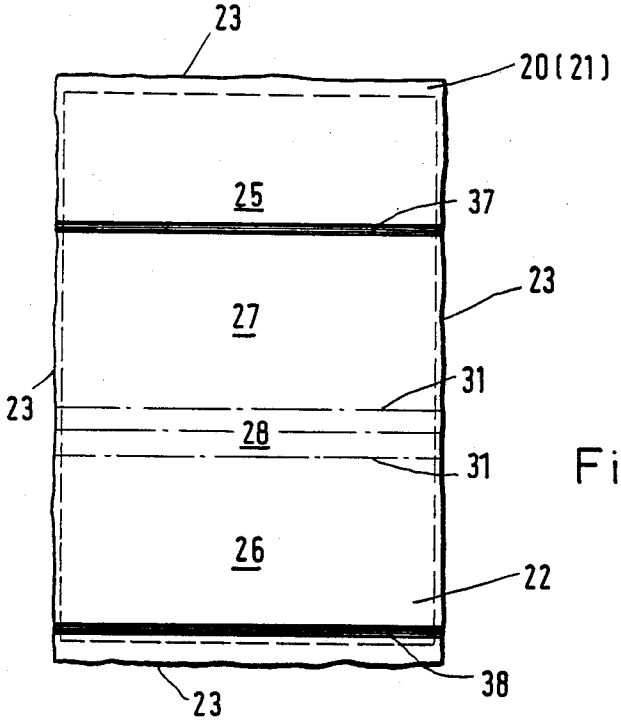

This is a Division of application Ser. No. 714,049, filed 3/20/85, now abandoned, which is a C-I-P of application Ser. No. 647,492 filed 9/5/84, now abandoned, which is a continuation of application Ser. No. 421,614, filed 9/22/82 now U.S. Pat. No. 4,505,385.

The invention relates to pouch packs for fibrous material, especially cut tobacco, consisting of a preferably multi-layer blank made of plastic foils, which forms a pocket with a front wall, a rear wall, a bottom and side walls and, as a continuation of the rear wall, a covering tab, an orifice of the pocket being sealed by a closing seam (weld or sealed seam). The invention also relates to a process for making a pouch pack of this type and to an apparatus.

Pouch packs for tobacco are known in various embodiments. The type of pack of this kind with which the invention is primarily concerned is referred to as a side-folding pouch or lateral fold. A characteristic of this is the design of the pocket for receiving the tobacco with a bottom and with side walls which, when the pouch is full, are directed perpendicularly to the front wall and the side wall. In pouch packs of this type, the rear wall of the pocket is extended and forms a covering tab which, when the pouch pack is closed, is folded over against the front wall of the pocket.

To improve the capacity for keeping the tobacco fresh (preservation of the aroma and moisture) over a prolonged period up to the time of use, pouch packs having a pocket orifice which is closed after filling are known. The closure is supposed to be easy to eliminate. Especially suitable for this purpose are tear-open sealed seams which are made by the heat-sealing of an applied strip of material (the so-called peel-seal seam).

The packs are made from a blank which originally has a rectangular shape. A particularly widespread embodiment of the pack consists, here, of 2 plastic foils connected to one another all-round on the side edges and of a paper insert located between these. This embodiment is disclosed in published U.K. patent application 2,061,713. The latter extends over the full dimensions of the blank with the exception of edge seams which are required. This necessarily presents folding difficulties at the transition from the pocket made with side walls into the covering tab made of equal width. If, for example, the (filled) pocket is erected into an approximately cuboid shape, there arise lateral strip-shaped projecting lengths in the region of the covering tab, specifically in a width of half the width of the side wall (side-wall half). This lateral projecting length of the covering tab is conventionally folded over inwards so that the covering tab essentially has the same width or transverse dimension as the pocket (or the front wall of the latter). In the known pouch packs designed as lateral fold or side-folding pouches, the transition from the pocket into the covering tab is achieved by folding the side walls of the pocket inwards in the form of a V in the region of the pocket orifice. Consequently, the side-wall halves form a V-shaped channel is this region. Its legs are continued, in the region of the covering tab and, if appropriate, in the region of a (shorter) gripping tab, as a strip-shaped projecting length folded over inwards. As a result, the finished full pouch pack is essentially cuboid without projecting lengths or gide strips caused by the covering or gripping tabs.

However, the above-mentioned solution is disadvantageous as regards the appropriate application of a closing or gealing seam in the region of the orifice. Irrespective of whether this is made, after filling, by thermal welding of the plastic foils or by activating strips of material previously applied, in either case the closing seam in the lateral regions of the pocket or the orifice is unsatisfactory because of the accumulation of material arising there as a result of the V-shaped folds. Leaky regions are obtained here. The paper insert has 4 layers here, with plastic foils located between each one. Outside the region of the V-shaped folds, only 2 layers of paper need be allowed for in welding.

Starting from this state of the art, the object on which the invention is based is to propose a pouch pack for tobacco or the like, in which the orifice of a pocket is provided with a perfect and continuously leak-proof closing seam (weld or sealed seam), but lateral projecting lengths of material as a result of filling of the pocket, especially when this is made with side walls, are nonetheless prevented.

To achieve this object, the pouch pack according to the invention is characterized in that the closing seam (weld or sealed seam) is made over the entire width of the spread-out blank, and lateral strip-shaped projecting lengths of the covering tab are folded over inwards in such a way that the covering tab has approximately the width of the front and rear walls.

In the design of the pouch pack according to the invention, especially in its design as a side-folding or lateral fold pouch, the side walls in the region of the orifice of the pocket are not folded inwards at first, but, rather are spread outwards, so that the front wall and rear wall of the pocket, including the side walls, rest against one another continuously, without folds, in this region, namely outside the filling material. The closing seam can now be made in a region of continuously indentical wall thicknesses or of a continuously identical wall structure. The preferred exemplary embodiment has 2 plastic foils with a paper insert located between them. This results in a uniform closing seam which is leak-proof over the entire length of the orifice. The lateral projecting length of the pouch pack thus formed in relation to the dimensions of the approximately cuboid pocket is eliminated by now being folded over inwards, namely against the inner side of the covering tab. This results, in the region of the orifice of the pocket, in a smooth transition from the strip-shaped projecting lengths into the side walls of the pocket.

The manufacture and filling of a pouch pack of this type is carried out in a special way according to the invention. After the pocket has been filled and closed, with the blank spread out, the pocket and covering tab are brought into an angular position relative to one another, in such a way that the covering tab is preformed in the direction of the end position (resting against the front wall of the pocket). It thereby becomes easier to fold over the strip-shaped projecting length without stretching the material. After folding-over, the inclined position of the covering tab is stabilized, as is also, at the same time, the folding-over of the lateral projecting length. Without the latter being attached, they are fixed in this way until the covering tab is laid against the front wall of the pocket. A return movement into the initial position as a result of a predetermined restoring force in the layers of material is prevented because of the inclined position of the covering tab.

The apparatus according to the invention is equipped with special folding members which allow the strip-shaped projecting lengths to be folded over perfectly in the region of a folding station.

Figure 2:
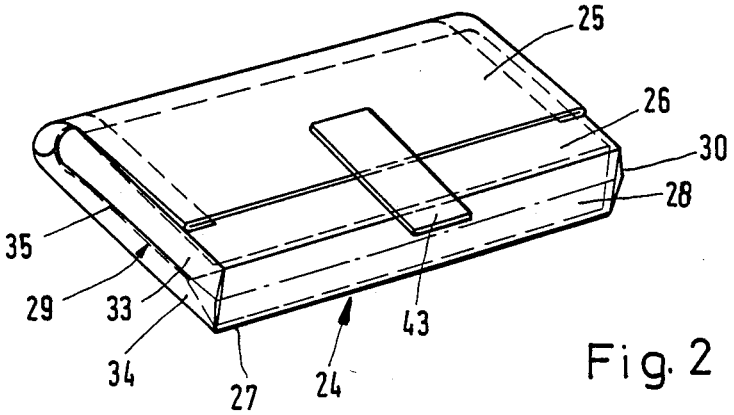
Figure 3:
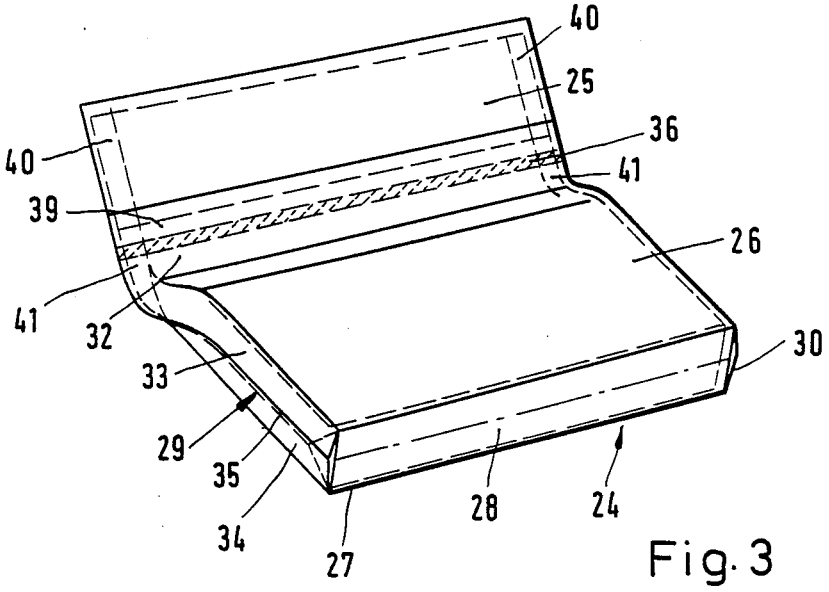
Figure 4:
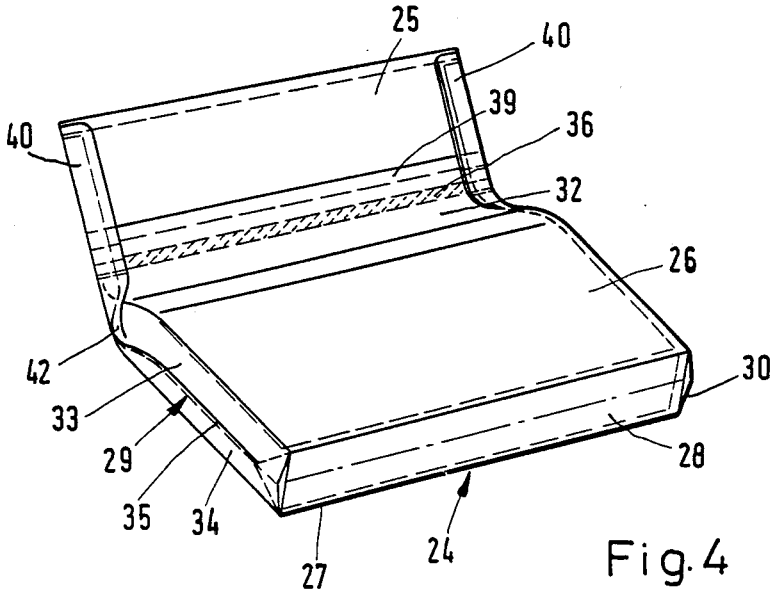
Figure 5:
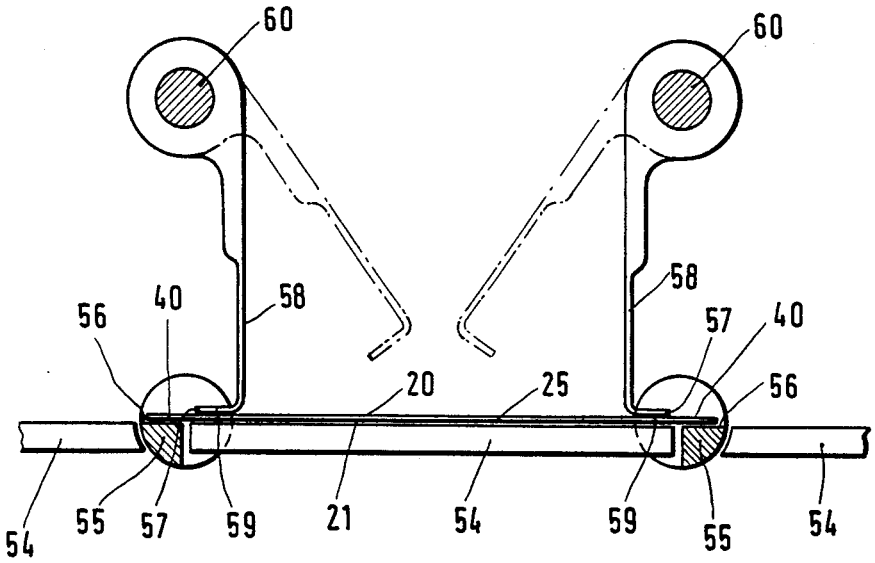
Figure 6:
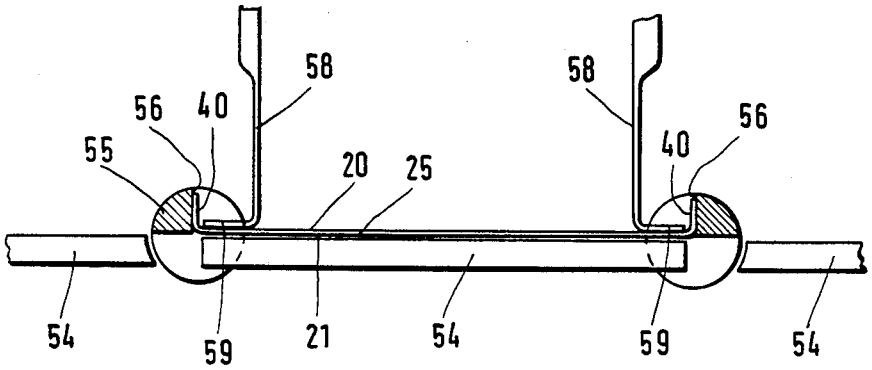
Figure 7:
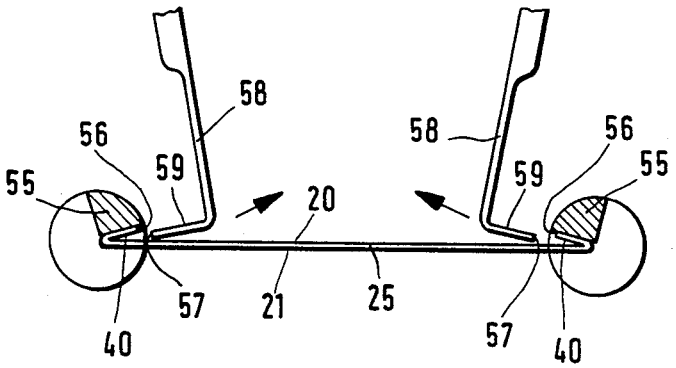
Figure 8:
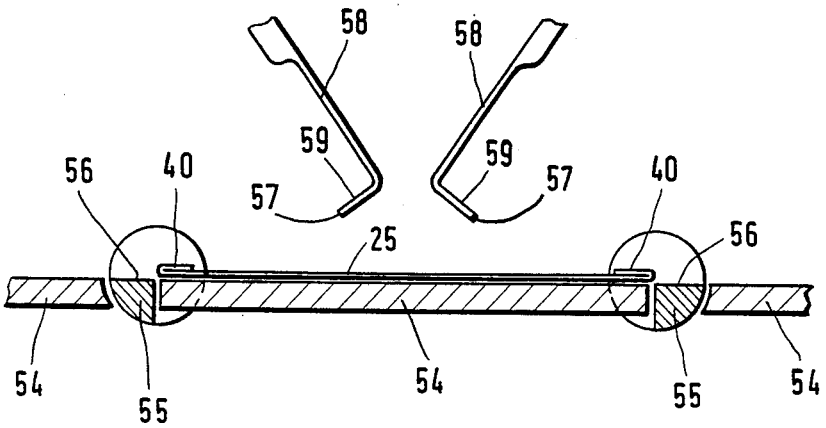
Figure 9:
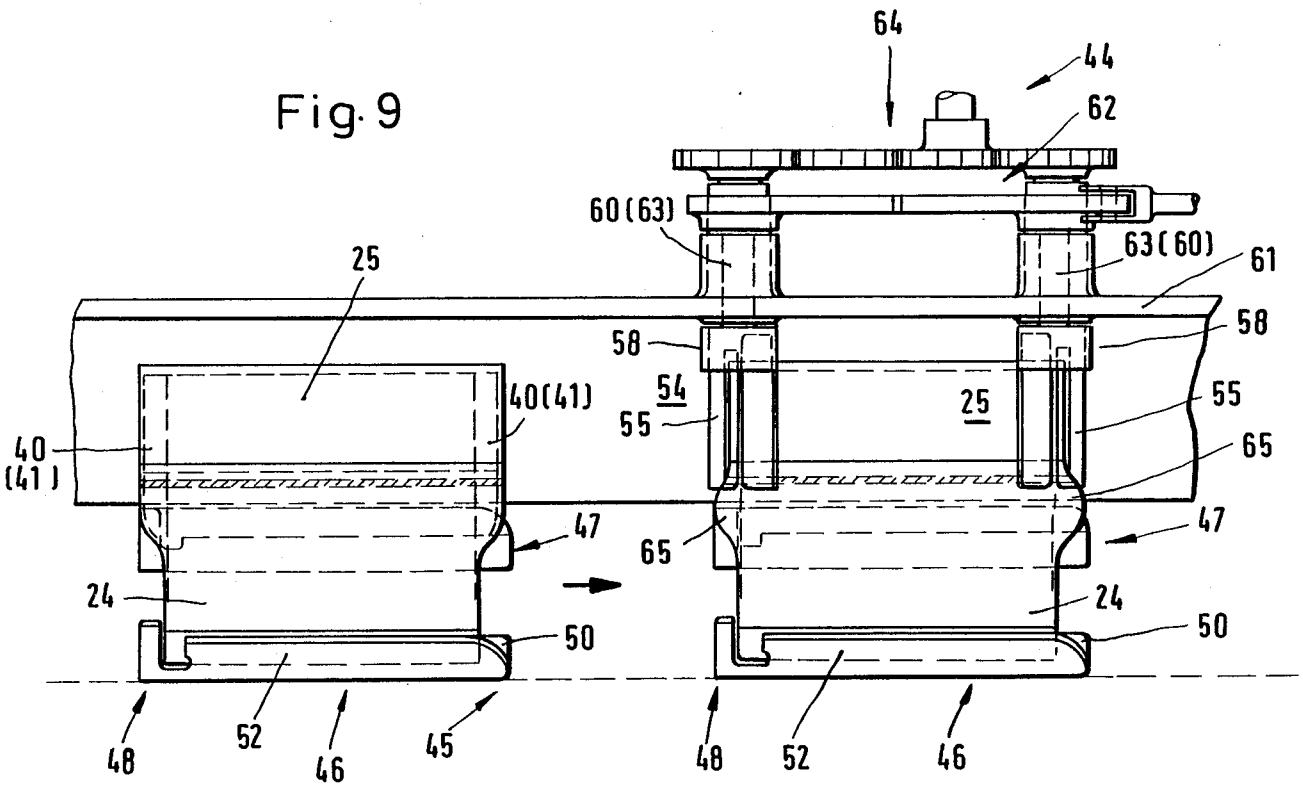
Figure 10:
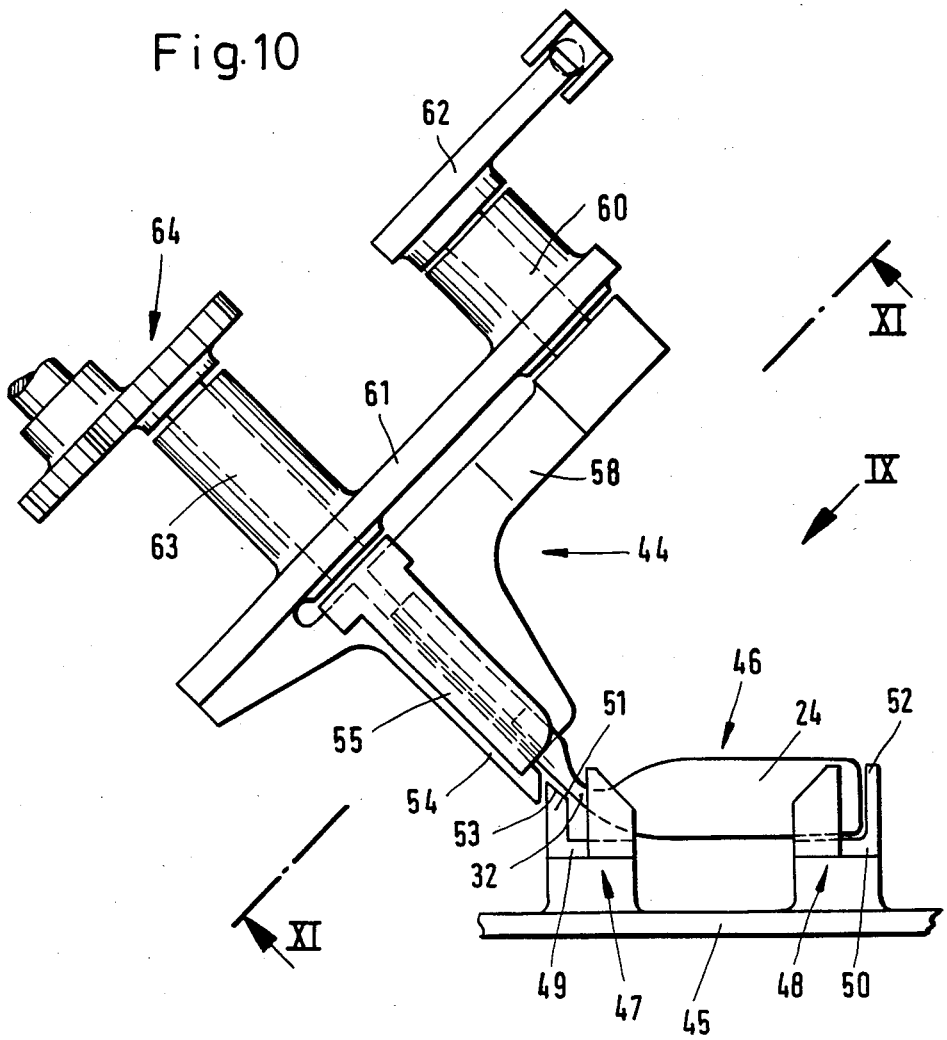
Figure 11:
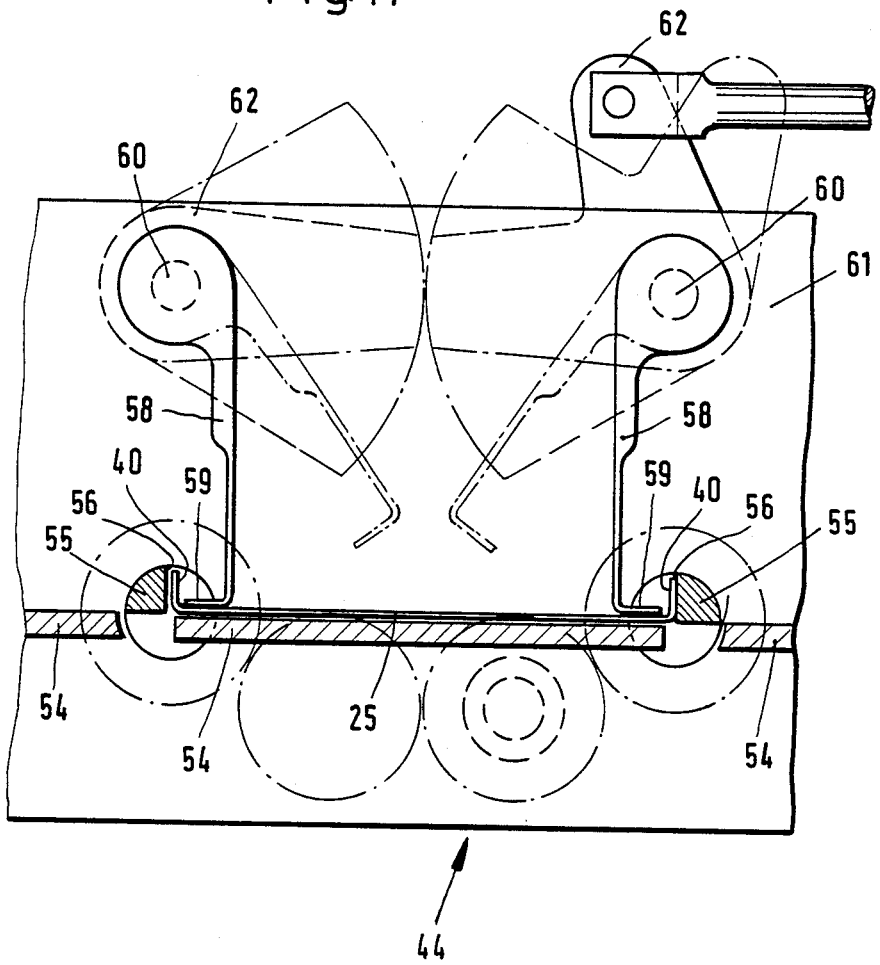

Exemplary embodiments of the pouch pack, the process for making this and the apparatus are explained in more detail below with reference to the drawings in which:

FIG. 1 shows a spread-out blank for making a pouch pack in a design as side-folding pouch, FIG. 2 shows a filled pouch pack in a perspective representation, FIG. 3 shows, in a perspective representation, the pouch pack according to FIG. 2 in an intermediate folding position, FIG. 4 shows the pouch pack in a representation corresponding to FIG. 3, after lateral projecting lengths have been folded over, FIG. 5 to FIG. 8 show different folding stages in the region of a covering tab of the pouch pack, in a cross-section of the latter, with folding members of a folding station, FIG. 9 shows in a plan view (view IX of FIG. 10) a folding apparatus, namely a folding station, for folding over lateral projecting lengths of a pouch pack, FIG. 10 shows the folding station in a side view, FIG. 11 shows a cross-section or view XI—XI of the folding station according to FIG. 10.

The exemplary embodiment, illustrated in the drawings, of a pouch pack for tobacco or the like and parts of an apparatus for processing this relate to the preferred field of application of the invention, namely the production and closing of side-folding pouches. These are conventionally formed from a rectangular blank according to FIG. 1. This consists of 2 (outer) foils 20 and 21 made of plastic. An insert 22 made of paper or the like is received between the foils 20 and 21 mentioned above. The aforesaid insert has approximately the dimensions of the foils 20, 21, so that the region between these is largely filled by the insert. The outer side of the insert 22 serves for receiving printing.

To form a uniform blank from the parts mentioned above, the foils 20, 21 are connected to one another all-round at their edges, especially by thermal welding, in the present exemplary embodiment by severing weld seams 23.

A pouch pack is formed from the blank according to FIG. 1, as is shown filled and closed in FIG. 2. This is a side-folding pouch with a pocket 24 for receiving the pack content (cut tobacco) and with a closure flap 25 connected to this. The pocket 24 is approximately cuboid, consisting, namely, of a front wall 26, a rear wall 27, a bottom 28 and side walls 29 and 30. Corresponding regions for forming the above-mentioned walls are marked on the blank or on the insert 22 by folding lines 31.

The pocket 24 is closed all-round with the exception of an orifice 32 which is continuous over the width of the pack or of the blank. This serves for introducing and extracting the tobacco. The remaining walls of the pocket 24 are closed, closed side walls 29 and 30 being formed by joining together side-wall halves 33 and 34 by means of a (central) connecting seam 35 in the region of the pocket. Because of its relative dimensions, the insert 22 also extends in the region of the side walls 29, 30, namely up to the connecting seam 35.

The orifice 32 of the pocket is closed in a leak-proof manner (hermetically) after filling, specifically by means of a closing strip 36 extending over the full length of the blank and consequently over the full length of the orifice 32. This closing strip is designed in a way known per se so that the walls connected to one another by the closing strip 36, in the present case the regions of the foil 20 which face one another, can be detached from one another again by pulling open the closing strip (the so-called peel-seal connection). In the present exemplary embodiment, strips of material 37 and 38 are applied in a suitable place to the unfolded blank according to FIG. 1, namely to the inner or upper foil 20. These strips of material are activated to make the closing strip 36 and are connected to one another by being pressed together. According to one embodiment, therefore, the strips of material 37 and 38 can consist of so-called hot-melt material. Alternatively, however, the closing strip 36 can also be made directly by gluing or by thermal welding of the foils 20.

As is evident especially from FIG. 3, the closure described above is made with the blank spread out or with the pack spread out in a transverse direction in the region of the orifice 32. The closing strip 36 thereby takes the form of a continuous closing means lying in one plane. The layers to be connected to one another or stratified above one another are continuously uniform, for they consist, in this region, of twice two foils 20, 21 and the double insert 22.

In the present exemplary embodiment, the closing strip 36, and consequently the orifice 32, is located in the region of a transition 42 from the walls of the pocket 24 to the adjoining closure flap 25 which is designed as a continuation or prolongation of the rear wall 27. In the region of the front wall 26 there is a gripping tab 39 which limits the orifice 32 and which is prolonged beyond the closing seam 35. In a similar way to the flap 25, this gripping tab is a continuation or prolongation of the front wall 26. Like the side-wall halves 33 and 34, the flap 25 and gripping tab 39 are connected to one another by the connecting seam 35. However, the flap 25 and gripping tab 39 can also be made separate from one another on the side of the closing strip 36 located opposite the pocket 24.

The flap 25 and the gripping tab 39 (FIG. 3), which are spread out in the above-mentioned way when the closing strip 36 is attached as well as thereafter, necessarily have a greater width than the approximately cuboid pocket 24. Lateral projecting lengths 40 of the flap 25 and 41 of the gripping tab 39 correspond in width to the transverse dimensions of the side-wall halves 33 and 34. To provide a largely cuboid closed pack according to FIG. 2 in the width of the (filled) pocket 24, the projecting lengths 40, 41 are folded over inwards, namely against the side of the flap 25 facing the front wall 26 when the pack is closed. As is evident especially from FIG. 4, the strip-shaped projecting length 40 of the flap 25, together with the (shorter) projecting length 41 of the gripping tab 39, is folded over appropriately, in such a way that the flap 25 and gripping tab 39 acquire the width of the pocket 24. Since the flap 25 lies in the plane of the rear wall 27 of the pocket 24, that is to say off-center, there arises a smooth transition 42 from the transversely directed side walls 29, 30 to the folded-over projecting lengths 40, 41 which, because of the shape of the blank, are continuations of the side walls 29, 30 or the side-wall halves 33, 34.

During the folding-over of the lateral stripshaped projecting lengths 40 and 41, the flap 25 (together with the gripping tab 39) is retained in an inclined position relative to the pocket, specifically the flap 25 is prefolded in the direction of its end position (resting against the front wall 26) (FIGS. 3, 4 and 10). As a result of this angled relative position of the flap 25 in relation to the pocket 24, it becomes easier to fold over the projecting lengths 40, 41, in such a way that straining or even stretching of the material cannot arise in this region. This also gives rise to the advantage that the folded-over strips (projecting lengths 40, 41) assume a relatively stable position, from which it is not possible for them to swing automatically into the initial position. On the contrary, in the further course of the process, the flap 25 can be folded against the front wall 26 together with the folded-over projecting lengths 40, 41. The flap 25 is conventionally fixed in this end position by a closing mark 43.

The folding operations described above are carried out in the region of a folding station 44 (FIGS. 9 and 10). The packs are conveyed, with the pockets filled, along a pack track which, in the present exemplary embodiment consists of a pocket chain 45. The pouch packs are received respectively by means of the pocket 24 in compartments 46 of this pocket chain 45. For this purpose, the compartments 46 consist of elongate lateral holders 47 and 48 which have an angular cross-section. Lower legs 49 and 50 serve for supporting the pocket 24, whilst vertical legs 51 and 52 guarantee that the pouches are fixed laterally. The lateral holders 47 and 48 designed in this way are connected to a revolving conveyor member (chains, belt or the like).

The flap 25 and the gripping tab 39 are located outside the compartments 46 of the pocket chain 45. The vertical leg 51 on the side facing the flap 25 is made with a smaller height and is provided with a sloping bearing face 53 for the flap 25 and the gripping tab 39. There adjoins this bearing face 53 a (fixed) bearing plate 54 which is directed at an angle to the conveying plane of the pocket chain 45, specifically preferably approximately at an angle of 45°. The bearing plate 54 serves, in the region of the folding station 44, for supporting the covering tab 25, whilst the projecting lengths 40, 41 are folded over in the way described.

For carrying out the folding operation there are in the region of the folding station 44 folding tools which grasp the flap 25, including the gripping tab 39, on the free sides. The above-mentioned folding members are elongate folding fingers 55 which extend on both sides of the flap 25. As a result of the rotation of the folding fingers 55 about their own longitudinal axis, the strip-shaped projecting lengths 40, 41 are raised from the plane position and finally folded over through an angle of 180°. The individual folding stages are shown diagrammatically in FIGS. 5 to 8. As is evident, the folding fingers 55 are made with a cross-section corresponding to the area of a quarter circle. The axis of rotation is located at the center point of the (imaginary) circle, that is to say off-center in relation to the folding fingers 55. A radially directed folding face 56 is rotated through 180° from an initial position in the plane of the flap 25 as a result of rotation of the folding finger 55 and is, at the same time, also displaced transversely in such a way that the folding finger 55 or its folding face 56 pivots the projecting length 40 or 41 against the top side of the flap 25 and presses it against the latter.

To achieve a clean folding edge at the margin of the flap 25, the above-described folding-over is carried out along a counter-edge 57. This is designed as a free edge of an angular bracing device 58 which, during the folding-over of the projecting lengths 40, 41, rests on the edge region of the covering tab by means of a lower pressure leg 59 extending in the plane of the flap 25. The covering tab is thereby retained, at the same time, in the exact folding position.

The bracing devices 58 are mounted pivotably on rotatable shafts 60. These are, in turn, mounted in a supporting plate 61 of the folding station 44. A corresponding to-and-fro drive 62 causes the bracing devices 58 to pivot respectively in the opposite direction into the folding position (the unbroken lines in FIGS. 5 and 6) or towards one another into the initial position according to FIG. 8. In this position, the pouch pack can be transported further after the projecting lengths 40, 41 have been folded over. As illustrated, the folding fingers 55 are returned into the initial position in which the folding face 56 extends in the plane of the bearing plate 54.

The folding fingers 55 are likewise connected to the ends of drive shafts 63 which are accommodated in the common supporting plate 61. The folding fingers 55 are driven to rotate to and fro by means of a toothed gearing 64.

FIG. 9 illustrates, with reference to the pouch pack in the folding station 44, that during the stage of folding over the projecting lengths 40, 41 there appears locally, namely in a region of the pocket 24 facing the flap 25, a lateral bulge 65 which disappears again when the projecting lengths 40 and 41 have been folded over completely. The pouch packs transported away from the folding station 44 in the arrangement according to FIG. 4 are, by further action, closed completely in a known way by folding over the inclined flap 25 against the front wall 26.

We claim:

1. Apparatus for making a pouch pack for fibrous material, especially cut tobacco; said pack being of the type comprising a multi-layer blank made of plastic foils and which forms a pocket with a front wall, a rear wall, a bottom and side walls and, as a continuation of the rear wall, a closure flap, an orifice of the pocket being closed by a closing strip, wherein the closing strip (36) is attached over the entire width of the spread-out blank, and lateral strip-shaped projecting lengths (40, 41) of the closure flap (25), including the closing strip (36), are folded over inwardly such that the closure flap has approximately the width of the front and rear walls (26, 27) of the pocket (24); in which apparatus, after the pocket (24) has been filled with fibrous material, with the blank lying flat and spread out in the region of the orifice (32) of the pocket, and the closing strip (36) extending over the entire length of the orifice has been made, the filled pouch pack is conveyed to folding station means (44) wherein the lateral strip-shaped projecting lengths (40, 41) of the closure flap (25) together with edge ends of the closing strip are folded inwardly against the inner side of the closure flap, and wherein, finally, the closure flap, together with the folded-over projecting lengths (40, 41), is folded over against the front wall (26) of the pocket; said apparatus comprising:

folding station means (44) for folding over the lateral projecting lengths (40, 41) and comprising: longitudinal folding fingers (55) which fold the projecting lengths (40, 41) over together through 180° from the spread-out position and press them against the closure flap (25); and supporting plate means (54) for holding said cover flap at an angle of approximately 45° to the pocket while said projecting lengths are being folded over.

2. Apparatus according to claim 14, wherein each of the folding fingers (55) has a folding face (56) and is rotatable about an offset longitudinal axis, in such a way that each of the projecting lengths (40, 41) is grasped by a folding face (56) extending, in the original position, in the plane of the closure flap (25), is folded over as a result of rotation of the folding finger through 180°, and is folded against the top side of the closure flap (25).

3. Apparatus according to claim 1 wherein the projecting lengths (40, 41) are folded round a counter-edge (57) extending periodically in the edge region of the closure flap (25).

4. Apparatus according to claim 3 wherein the counter-edge (57) is the edge of a pressure leg (59) of a bracing device (58), and during the folding over of the projecting lengths (40, 41) the pressure leg (59) rests in the edge region of the closure flap (25) on the top side of the latter.

5. Apparatus according to claim 1 further comprising conveyor means for conveying the filled pouch packs and including a pocket chain (45), the pockets of pouch packs being received in respective compartments (46) of the pocket chain.

* * * * *